US005399222A

United States Patent [19]

Reist

[11] Patent Number: 5,399,222

[45] Date of Patent: Mar. 21, 1995

[54] PROCESS AND APPARATUS FOR THE PROCESSING OF PRINTING PRODUCTS ARRIVING IN AN IMBRICATED FORMATION

[75] Inventor: Walter Reist, Hinwil, Switzerland

[73] Assignee: Ferag AG, Switzerland

[21] Appl. No.: 131,562

[22] Filed: Oct. 4, 1993

Related U.S. Application Data

[63] Continuation of Ser. No. 943,985, Sep. 11, 1992, which is a continuation of Ser. No. 579,954, Sep. 10, 1990, abandoned.

[30] Foreign Application Priority Data

Sep. 13, 1989 [CH] Switzerland ..... 03337/89

[51] Int. Cl.[6] ..... B65H 3/00

[52] U.S. Cl. ..... 156/277; 198/367; 198/444; 271/151; 271/184; 271/216

[58] Field of Search ..... 156/277, DIG. 27; 198/367, 442, 437, 444; 271/198, 199, 200, 98, 149, 150, 151, 169, 170, 184, 216, 237, 250, 251, 252, 280, 247, 302, 303, 304, 305; 270/54

[56] References Cited

U.S. PATENT DOCUMENTS

| | | | |
|---|---|---|---|
| 2,754,953 | 7/1956 | Groncy | 198/33 |
| 3,044,772 | 7/1962 | Trenner | 271/68 |
| 3,239,676 | 3/1966 | Pali | 250/223 |
| 3,257,110 | 6/1966 | Smethurst | 271/216 |
| 3,430,784 | 3/1969 | Hall | 271/65 |
| 3,473,244 | 10/1969 | Milone et al. | 100/153 X |
| 3,545,371 | 12/1970 | Reist | 100/176 |
| 3,669,008 | 6/1972 | Reist | 100/35 |
| 3,915,785 | 10/1975 | Müller | 156/355 X |
| 3,977,537 | 8/1976 | Buccicone | 271/64 X |
| 4,201,377 | 5/1980 | Honegger | 271/225 |
| 4,311,230 | 1/1982 | Crawford et al. | 198/457 |
| 4,456,242 | 6/1984 | Morin | 271/94 |
| 4,482,142 | 11/1984 | McCain et al. | 270/54 |
| 4,534,550 | 8/1985 | Reist | 271/183 |
| 4,538,161 | 8/1985 | Reist | 346/140 R |
| 4,566,582 | 1/1986 | Linder | 271/302 X |
| 4,572,350 | 2/1986 | Besemann | 198/372 |
| 4,619,728 | 10/1986 | Brink | 156/555 |
| 4,903,600 | 2/1990 | Long | 101/485 |
| 4,953,843 | 9/1990 | Reist | 271/3.1 |
| 4,986,730 | 1/1991 | Wetter | 414/792.7 |
| 5,048,818 | 9/1991 | Nemeskal | 271/216 X |

FOREIGN PATENT DOCUMENTS

| | | |
|---|---|---|
| 0038918 | 11/1981 | European Pat. Off. . |
| 0326518 | 1/1989 | European Pat. Off. . |
| 295382 | 7/1915 | Germany . |
| 590480 | 1/1934 | Germany . |
| 2027422 | 11/1974 | Germany . |
| 2820957 | 12/1978 | Germany . |
| 3517775 | 1/1986 | Germany . |
| 566925 | 9/1975 | Switzerland . |
| 484093 | 12/1975 | U.S.S.R. . |

*Primary Examiner*—David A. Simmons
*Assistant Examiner*—James J. Engel
*Attorney, Agent, or Firm*—Oliff & Berridge

[57] ABSTRACT

A belt conveyor leads past a processing station. Printing products lie on the conveyor belt in an imbricated formation, each printing product lying on the preceding one with edges to of the printing products running at an angle to the conveying direction of the belt conveyor. As a result of this incline, the printing products are exposed in a surface region and in the sections of the edges. Printing products are acted upon mechanically in the work station in these exposed regions. Individual printing products are thus taken up in a trouble-free manner and detached from the imbricated formation.

9 Claims, 2 Drawing Sheets

PROCESS AND APPARATUS FOR THE PROCESSING OF PRINTING PRODUCTS ARRIVING IN AN IMBRICATED FORMATION

This is a continuation of application Ser. No. 07/943,985, filed Sep. 11, 1992, which is a continuation of application Ser. No. 07/579,954, filed Sep. 10, 1990, now abandoned.

BACKGROUND OF THE INVENTION

1. Field of the Invention

The present invention relates to a process and an apparatus for respectively processing printing products arriving in an imbricated formation, in particular multi-sheet and folded printing products such as newspapers, periodicals and the like.

2. Description of the Related Art

Apparatus for processing printing products arriving in an imbricated formation are known, for example, from DE-A 2,820,957 and CH-A 566,925. The printing products are conveyed to a processing station by means of a belt conveyor in an imbricated formation in which each printing product lies on the preceding one. The processing station has an extraction arrangement arranged above the belt conveyor and on which a tongue-shaped switch element is provided which, in order to detach individual or several successive printing products (in particular spoiled copies) from the imbricated formation, may be lowered so as to be inserted into the imbricated formation and reach underneath the printing products to be detached at their leading edge running at right angles to the conveying direction. The printing products deflected upwards by means of the switch element are then taken up and conveyed away by accelerating belts. In order to expose the leading edge of the printing products, the imbricated formation may be guided over a step in the belt conveyor.

Each time the detaching of printing products is complete, the extraction arrangement is to be raised upwards in order to free the last deflected printing product, which reaches underneath the succeeding one, from the latter, and in order to remove the switch element from the region of action upon the printing products. Those printing products not to be detached from the imbricated formation are conveyed past the processing station by means of the belt conveyor with their mutual position unaltered. The speed of the accelerating belt and the raising of the extraction arrangement is to be matched exactly to and synchronized with the conveying speed, the size of the printing products, and their overlap. Furthermore, these apparatus are not suitable for the processing of imbricated formations in which the leading edge of each printing product is covered in each case by the preceding printing product.

A further device for the processing of printing products arriving in imbricated formation is known from EP-A 0,096,228 and the corresponding U.S. Pat. No. 4,538,161. The printing products are held individually by grippers of a conveyor in the region of their leading edge running at right angles to the conveying direction, and drawn with their trailing region over a support. They are thus marked (addressed) in the region of the trailing edge.

A further process and a corresponding apparatus for the processing of printing products are known from EP-A1 0,300,179. The printing products are conveyed to a processing station in an imbricated formation in which, viewed in the conveying direction, each printing product lies on the preceding one, the leading and trailing edges, respectively, of the printing products run at right angles to the conveying direction and the side edges are aligned with one another. The processing station has an accelerating device acting mechanically upon the printing products in order to separate the printing products, and a switch device for feeding the separated printing products optionally to one of two belt conveyors following the processing station downstream. A further imbricated formation, which corresponds to the fed imbricated formation, is formed from the individual printing products fed to the belt conveyors. In the processing station, the printing products retain their position with respect to the conveying direction. In order to be able to deflect the printing products fed in imbricated formation, these printing products must first be exposed by separation, which entails for processing considerable expense and the destruction every time of the fed imbricated formation.

An apparatus for applying safety stitching to a corner region of printing products is known from German Patent Specification 590,480. The multi-sheet printing products are delivered in imbricated formation by means of a star-shaped delivery wheel onto a belt conveyor running at 45° transverse to the axis of the wheel. In the imbricated formation, each printing product lies on the preceding one and the edges of the printing products run at an angle with respect to the conveying direction of the belt conveyor. The corner regions, exposed and projecting laterally from the belt conveyor, of the printing products are stitched by a sewing machine (safety stitching) and the thread between the successive stitched printing products is subsequently cut. The printing products are deflected to form an imbricated formation for further processing in which the leading edges run at right angles to the conveying direction.

German Offenlegungsschrift 3,335,140 and German Auslegeschrift 2,027,422 furthermore disclose apparatus for branching off printed sheets or newspapers fed in an imbricated formation. In this imbricated formation, the leading edges, viewed in the conveying direction, of the printing products run at right angles to the conveying direction and the side edges are aligned with one another. The printing products to be branched off are conveyed, approximately in the direction of one of their diagonals, just in a transition section, such that they are inclined with respect to their conveying direction in the transition section. The sole purpose of this incline is to form a further imbricated formation, which corresponds to the original imbricated formation, from the branched-off printing products on the conveyor following downstream respectively and whose conveying direction runs parallel to the feed direction.

U.S. Pat. No. 3,239,676 furthermore discloses an apparatus for the contactless counting by means of a light barrier of signature sheets conveyed in an imbricated formation. This apparatus has a first belt conveyor on which the signature sheets are arranged in an imbricated formation in which each signature sheet lies on the preceding one and the side edges of the signature sheets are aligned with one another parallel to the conveying direction of this belt conveyor. At the end of the first belt conveyor, the signature sheets drop onto a second belt conveyor whose conveying direction runs offset to the conveying direction of the first belt conveyor, viewed in a horizontal plane, by 45° and whose conveying speed is greater than the conveying speed of the first belt conveyor. An imbricated formation is thus formed on the second belt conveyor in which the edges of the signature sheets run rotated through 45° with respect to the conveying direction of this second belt conveyor and in which the distance between corresponding edges of successive signature sheets is increased. In the region of one edge of this imbricated formation, thus running with a sawtooth shape, the light barrier is arranged, the light beam of which is interrupted by a corner region of each signature sheet forming a tooth of this edge. At the end of the second belt conveyor, the signature sheets drop onto a further belt conveyor whose conveying direction runs parallel to the conveying direction of the first belt conveyor and whose conveying speed is the same as the conveying speed of the first belt conveyor, in order to form an imbricated formation which corresponds exactly to the fed imbricated formation from the first belt conveyor.

All these apparatus known from German Offenlegungsschrift 3,335,140, from German Auslegeschrift 2,027,442 and from U.S. Pat. No. 3,239,676 have the common feature that in the region in which the edges of the sheets or newspapers run at an angle with respect to their temporary conveying direction, no influence is exerted, so as not to disturb the formation and so as to ensure the conveying away in an imbricated formation which corresponds to the fed imbricated formation.

SUMMARY OF THE INVENTION

The object of the present invention is to develop further a known process and to provide a corresponding generic apparatus, which process and which apparatus permit printing products to be processed in a simple, trouble-free and operationally reliable manner, independent of the relative position of the printing products in the imbricated formation.

This object is achieved by feeding printing products, arriving in an imbricated formation overlapping one another in a conveying direction, to a processing station where printing products are acted upon to detach them from the formation, and printing products not acted upon are led past the processing station essentially retaining their position with respect to the conveying direction. The edges of the printing products are inclined with respect to the conveying direction so as to expose a region of the printing products.

As a result of the incline of the printing products, an edge region is exposed which includes all four edges and a strip-shaped surface region along two adjacent edges on each flat side of the printing products. The printing products may thus without any difficulty be taken up individually in the imbricated formation at lateral exposed corner regions viewed in the conveying direction, by means of grippers or by hand, and detached from the imbricated formation, which is made possible in an imbricated formation in which the printing products are aligned with their leading edges at right angles to the conveying direction and with their side edges aligned only by complicated separation or exposure of edge regions of the printing products, for which it may be necessary to destroy the imbricated formation. In the exposed surface region, the printing products may be mechanically influenced, for example addressed, along two edges without having to be detached from the imbricated formation, which is possible in a conventional imbricated formation with side edges aligned with one another only along the leading and trailing edges, respectively. Sides and sections of sides are also freely accessible to mechanical influence.

Preferred further developments of the process according to the invention and embodiments of the apparatus according to the invention are also provided.

BRIEF DESCRIPTION OF THE DRAWINGS

The invention is now described in more detail with reference to the exemplary embodiments shown in the drawings, in which purely schematically.

DETAILED DESCRIPTION OF PREFERRED EMBODIMENTS

Figure 1:
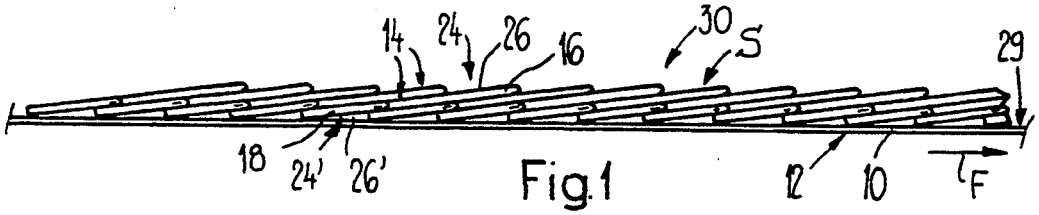
FIGS. 1 to 4 show in side view and top view two different imbricated formations, from which individual printing products are detached.
Figure 2:
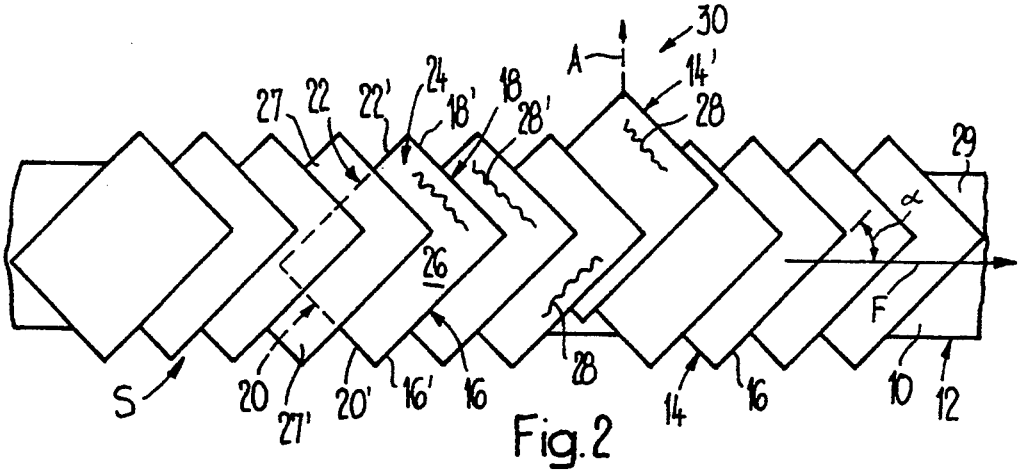

FIGS. 1 and 2 show, in side view and top view, respectively, a part of the active conveying side of a conveyor belt 10, driven so as to circulate in a conveying direction F, of a generally known belt conveyor 12. Multi-sheet folded printing products 14 such as, for example, newspapers, periodicals and the like or parts thereof, lie on the conveyor belt 10 in an imbricated formation S in which each printing product 14 lies on the preceding printing product 14, viewed in the conveying direction F. The folded edges of the printing products 14 are designated by 16, the two side edges adjoining these by 18 and 20 and the open edge in each case opposite the folded edge 16, the so-called foreedge, by 22. The edges 16 to 22 run at an angle to the conveying direction F, the folded edge 16 including with the conveying direction F an angle $\alpha$ of approximately 45° in the present example. This angle $\alpha$ may, of course, also be smaller or larger and preferably lies between 10° and 80°. A section, correspondingly designated by 16' to 22' of each edge 16 to 22 is thus exposed which is not covered by any of the adjacent printing products 14 and is flush with an edge 16 to 22 of the same (see in particular FIG. 2). Furthermore, a surface region 26 which extends in strip form along the folded edge 16 and the side edge 18 is exposed on the upper flat side 24 of the printing products 14. A corresponding surface region 26' running along the edges 20 and 22 is exposed on the lower flat side 24' of the printing products 14 and is freely accessible at least on the region outside the conveyor belt 10. The freely accessible surface regions 26, 26' and edges 16 to 22 or sections 16' to 22' define an exposed edge region. It is to be noted that the two exposed surface regions 26, 26' overlap one another regionwise in lateral corner regions 27, 27'. Printing products 14 are provided in the upper surface region 26 with a schematically indicated code 28 or 28' respectively, for example a marking, which runs along the folded edge 16 or the side edge 18. The printing product referenced by 14' is shown offset with respect to the other printing products 14 of the imbricated formation S in the conveying plane 29 defined by the belt conveyor 12 in a direction, shown by the arrow A, transverse to the conveying direction F.

The conveyor belt 10 leads past a processing station 30 provided at the arrow A. An operator is provided at this processing station 30 who in each case detaches from the imbricated formation S in direction of arrow A each printing product 14 having a specific code 28 and deposits it in a space provided for this purpose. On the other hand, printing products 14 without any code or with a code, referenced by 28' which is not correct are left in the imbricated formation S and conveyed on by the conveyor belt 10 in direction of arrow F. In order to detach individual printing products 14 from the imbricated formation S, they may be taken up without difficulty in the corner region 27 delimited by the sections 18' and 22'. Moreover, the inclining of the printing products 14 enables codes 28, 28' along two edges 16, 18 of the printing products 14 to be recognized without any difficulty. A wide variety of different printing products 14 arranged in an imbricated formation S may thus be sorted, in which the code 28, 28' for example the title of the printing product 14, runs at right angles or parallel to the folded edge 16.

Figure 3:
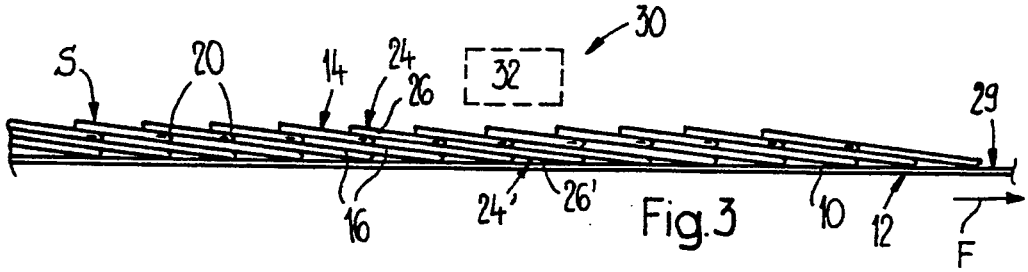
Figure 4:
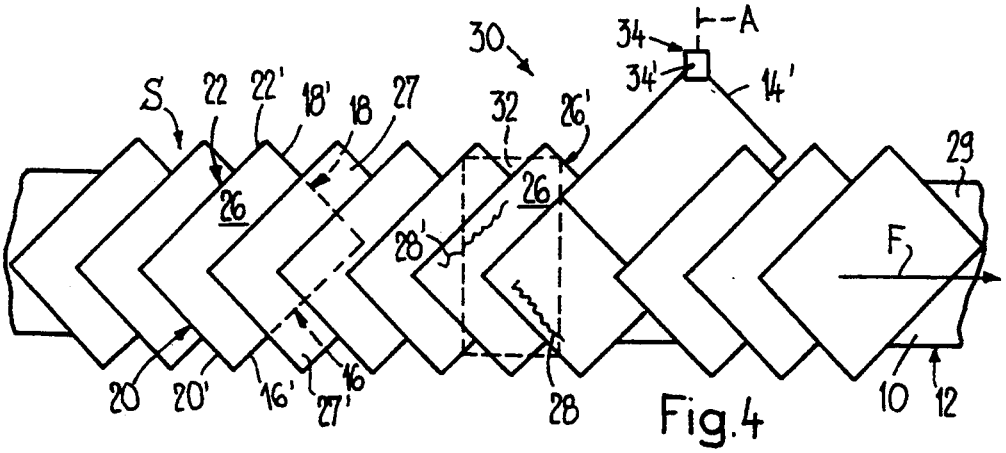
Figure 5:
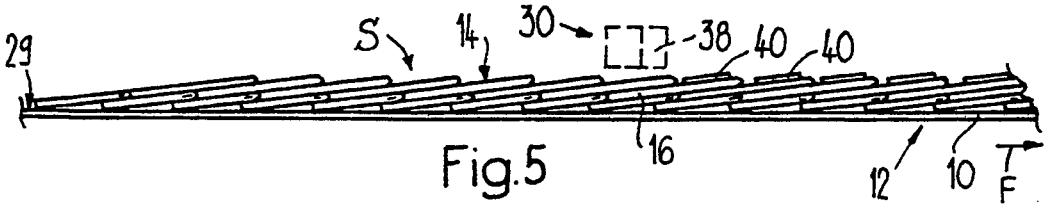
FIGS. 5 to 8 show in a similar representation the same imbricated formations, a marking being attached to the printing products.
Figure 6:
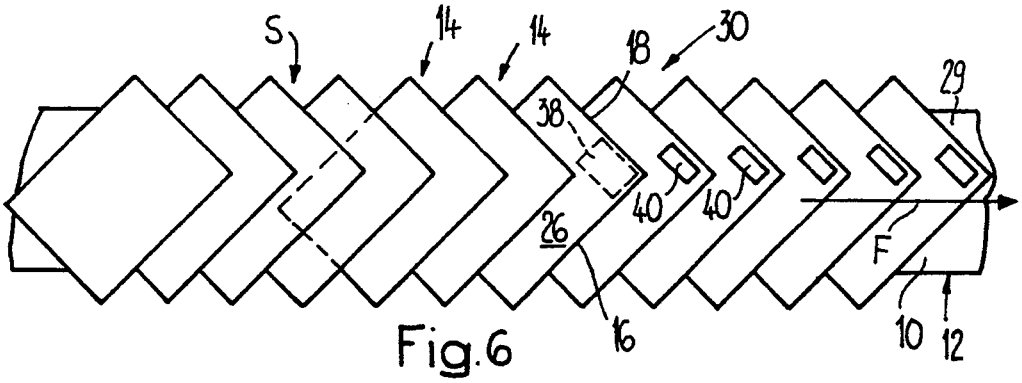

In the exemplary embodiment according to FIGS. 3 and 4, the printing products 14 likewise lie in an imbricated formation S on the active conveying side of the conveyor belt 10 (shown only partially) of the belt conveyor 12. The conveyor belt 10 is driven so as to circulate in the direction of arrow F. Each printing product 14 lies, viewed in the conveying direction F, in each case on the following printing product 14. The leading folded edge 16, viewed in the conveying direction F, and side edge 18 are in each case only partially covered by the preceding printing product 14 since the edges 16 to 22 likewise run at an angle to the conveying direction F. The exposed sections of the edges 16 to 22 are likewise designated by 16' to 22'. Codes 28, 28' are attached to printing products 14 in the exposed surface region 26.

The processing station 30 has, above the conveyor belt 10, a read device 32 indicated only schematically. This read device 32 reads off the codes 28, 28' on the printing products 14 and sends corresponding signals to a gripper arrangement 34, indicated only schematically, of the processing station 30 (FIG. 4). The processing station 30 has a controllable gripper 34' which, as a function of the signals emitted by the read device 32, takes up a printing product 14' in the corner region 27 and detaches it, in direction of arrow A, approximately parallel to the conveying plane 29 and at right angles to the conveying direction F, from the imbricated formation S, or leaves the printing product 14 in question in the imbricated formation S. The work carried out by the operator for the apparatus according to FIGS. 1 and 2 is performed, in the embodiment according to FIGS. 3 and 4, by the read device 32 and the gripper arrangement 34. Those printing products 14 not detached from the imbricated formation S by the operator or by the gripper arrangement 34 retain their position with respect to the conveying direction F and are conveyed on by the belt conveyor 12, for example to a further processing station.

In the embodiments according to FIGS. 5 and 6, and 7 and 8, respectively, the printing products 14 are arranged on a conveyor belt 10 in an imbricated formation S corresponding to FIGS. 1 and 2, and FIGS. 3 and 4, respectively. The two imbricated formations S will therefore only be further described to the extent that this is necessary for the comprehension of FIGS. 5 to 8. The only partially shown endless conveyor belt 10 is driven in circulating direction F. In the imbricated formation S according to FIGS. 5 and 6, each printing product 14, viewed in conveying direction F, lies on the preceding printing product 14. The surface region 26 along the two leading edges, along the folded edge 16 and along the side edge 18 is thus exposed. A schematically indicated sticking-on device 38 is arranged above the conveyor belt 10 and sticks, in a known way, a label 40, for example having the address of the consignee of the printing product, onto each printing product 14.

The label 40 may be attached at any desired point within the surface region 26. This includes along the side edge 18 which would, in an imbricated formation in which side edges are aligned with one another, in each case be covered by the following printing product 14. The printing products 14 are in this case led past the sticking-on device 38 of the processing station 30 without changing their position within the imbricated formation S.

Figure 7:
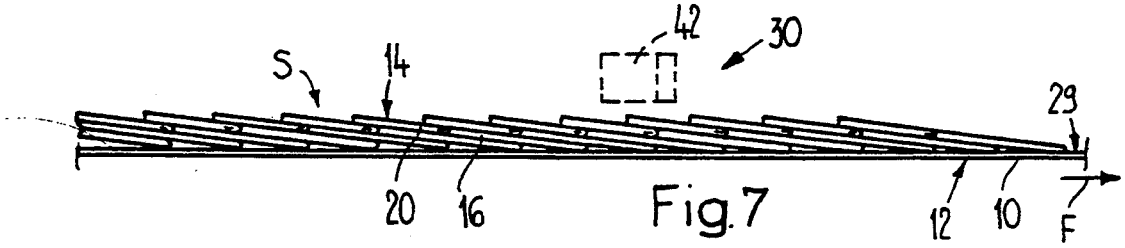
Figure 8:
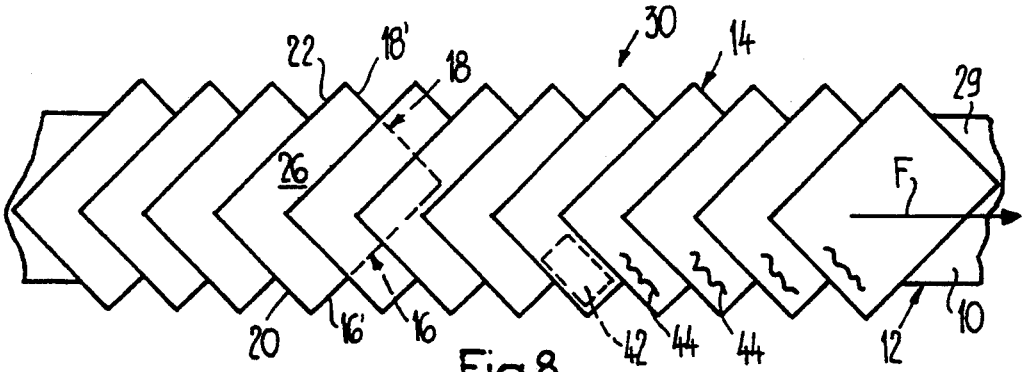

In the imbricated formation S according to FIGS. 7 and 8, each printing product lies, viewed in conveying direction F, on the following printing product 14. The upper exposed surface region 26 thus extends along the two trailing edges 20 and 22 which are not covered by the preceding printing product 14. The sections 16', 18' of the two leading edges (viewed in conveying direction F), the folded edge 16 and the side edge 18, are thus also exposed. In the region of the processing station 30, a printer 42, indicated only schematically, is provided above the belt conveyor 12 and attaches a marking 44, for example the address of the consignee of the printing product, to the printing products 14 in the surface region 26 along the side edge 20. It should be noted that the marking 44 may optionally be attached in the entire surface region 26, including along the side edge 20 which, in an imbricated formation in which the folded edge 16 is in each case arranged at right angles to the conveying direction F, is covered by the preceding printing product 14. The printing products 14 are conveyed in the imbricated formation S past the processing station 30 and fed to a further-processing station.

It is, of course, also possible to displace printing products 14 in direction of arrow A by means of an extraction element which can be brought to act upon one of the leading edges 16, 18.

While the invention has been described with reference to particular preferred embodiments, the invention is not limited to the specific examples given, and other embodiments and modifications can be made by those skilled in the art without departing from the spirit and scope of the invention.

What is claimed is:

1. A method for processing a plurality of printing products conveyed in a conveying plane by a conveyor moving the plurality of printing products in a conveying direction through a processing station, each printing product having a first surface facing the conveyor and a second surface opposite the first surface, the method comprising the steps of:

feeding the plurality of printing products in the conveying direction through the processing station in an inclined imbricated formation in which all edges of each printing product are inclined at an acute angle to a line orthogonal to the conveying direction to define an uncovered edge region for each printing product that is not covered by an adjacent printing product;

exposing the first and second surfaces of lateral corners of the edge region for each printing product, the lateral corners extending beyond lateral edges of the conveyor;

processing a selected one of the plurality of printing products in the processing station by extracting the selected one of the printing products from the inclined imbricated formation by acting on one lateral corner to move the printing product in a direction transverse to the conveying direction; and maintaining the extracted printing products in the conveying plane and the unextracted printing products in the inclined imbricated formation during said processing step.

2. The method of claim 1, wherein each printing product has a leading portion and a trailing portion relative to the conveying direction, and the selected one of the plurality of printing products is extracted regardless of whether the uncovered edge region is located on the leading or trailing portion.

3. The method of claim 1, wherein the unextracted printing products exiting the processing station are conveyed past the processing station in an essentially unaltered relative position in the inclined imbricated formation.

4. The method of claim 1, further comprising the step of reading a code on the uncovered edge regions of the plurality of printing products before extracting the selected one of the plurality of printing products, and determining the selected one of the plurality of printing products based on the code.

5. A method for processing a plurality of printing products conveyed in a conveying plane by a conveyor moving the plurality of printing products in a conveying direction through a processing station, each printing product having a first surface facing the conveyor and a second surface opposite the first surface, the method comprising the steps of:

feeding the plurality of printing products in the conveying direction through the processing station in an inclined imbricated formation in which all edges of each printing product are inclined at an acute angle to a line orthogonal to the conveying direction to define an uncovered edge region along selected first and second edges for each printing product that is not covered by an adjacent printing product;

exposing the first and second surfaces of lateral corners of the edge region for each printing product, the lateral corners extending beyond lateral edges of the conveyor;

mechanically influencing the plurality of printing products in the processing station by selectively applying information to either one or both of said selected first and second edges of the uncovered edge regions of the plurality of printing products; and maintaining the printing products in the conveying plane and in the inclined imbricated formation during said mechanical influencing step.

6. The method of claim 5, wherein the step of applying information includes printing information in the uncovered edge region.

7. The method of claim 5, wherein the step of applying information includes attaching a label with information printed thereon to the uncovered edge region.

8. The method of claim 5, wherein the step of applying information to the uncovered edge region includes applying information to the lateral corner of the uncovered edge region.

9. The method of claim 5, wherein the step of mechanically influencing includes selectively applying information regardless of whether the uncovered edge regions are located on a leading portion or a trailing portion of the printing product.

* * * * *